US007405700B2

(12) United States Patent
Duzdar et al.

(10) Patent No.: US 7,405,700 B2
(45) Date of Patent: Jul. 29, 2008

(54) SINGLE-FEED MULTI-FREQUENCY MULTI-POLARIZATION ANTENNA

(75) Inventors: Ayman Duzdar, Holly, MI (US); Andreas D. Fuchs, Orion, MI (US)

(73) Assignee: Laird Technologies, Inc., St. Louis, MO (US)

( * ) Notice: Subject to any disclaimer, the term of this patent is extended or adjusted under 35 U.S.C. 154(b) by 0 days.

(21) Appl. No.: 11/633,923

(22) Filed: Dec. 5, 2006

(65) Prior Publication Data

US 2007/0222683 A1 Sep. 27, 2007

Related U.S. Application Data

(63) Continuation of application No. 11/145,878, filed on Jun. 6, 2005, now Pat. No. 7,164,385.

(51) Int. Cl.
*H01Q 1/38* (2006.01)

(52) U.S. Cl. ..... 343/700 MS

(58) Field of Classification Search ..... 343/700 MS, 343/846, 702, 711, 713
See application file for complete search history.

(56) References Cited

U.S. PATENT DOCUMENTS

| | | | |
|---|---|---|---|
| 4,132,995 | A | 1/1979 | Monser |
| 4,827,271 | A | 5/1989 | Berneking et al. |
| 4,873,529 | A | 10/1989 | Gibson |
| 6,008,770 | A | 12/1999 | Sugawara |
| 6,181,281 | B1 | 1/2001 | Desclos et al. |
| 6,466,768 | B1 | 10/2002 | Agahi-Kesheh et al. |
| 6,538,609 | B2 | 3/2003 | Nguyen et al. |
| 6,762,729 | B2 | 7/2004 | Egashira et al. |
| 6,806,838 | B2 | 10/2004 | Petros et al. |
| 6,825,803 | B2 | 11/2004 | Wixforth et al. |
| 7,019,705 | B2 | 3/2006 | Pfletschinger et al. |
| 7,116,952 | B2 | 10/2006 | Arafa |

(Continued)

FOREIGN PATENT DOCUMENTS

| | | | |
|---|---|---|---|
| DE | 101 33 295 | A1 | 1/2003 |

(Continued)

OTHER PUBLICATIONS

E.B. Perri, "Dual band cellular antenna in a multifunction platform for vehicular applications", 2006 IEEE, University of Sao Paulo—Dept. of Telecommunications and Control Engineering Av. Prof. Luciano Gualberto, trav. 3, 158 ZC 05508-900 Sao Paulo, Brazil (2006) pp. 2361-2364.

(Continued)

*Primary Examiner*—Hoang V Nguyen
(74) *Attorney, Agent, or Firm*—Harness, Dickey & Pierce, P.L.C.

(57) ABSTRACT

Various embodiments provide antennas capable of receiving both left-hand circularly polarized (LHCP) signals and right-hand circularly polarized (RHCP) signals, and outputting both signals on a single feed. In one exemplary embodiment, an antenna generally includes two substantially coplanar concentric patches. The inner patch is substantially square. The outer patch has inner and outer edges both of which are substantially square. The two patches do not physically contact one another. A single feed is connected to the inner patch. The inner patch receives the LHCP signal, and the two patches operate collectively together for receiving the RHCP signal.

26 Claims, 14 Drawing Sheets

U.S. PATENT DOCUMENTS

| | | | |
|---|---|---|---|
| 7,164,385 | B2 | 1/2007 | Duzdar et al. |
| 7,253,770 | B2 * | 8/2007 | Yegin et al. ..... 343/700 MS |
| 2003/0052825 | A1 | 3/2003 | Rao et al. |
| 2004/0051661 | A1 | 3/2004 | Wixforth et al. |
| 2004/0051675 | A1 | 3/2004 | Inoue |
| 2004/0072575 | A1 | 4/2004 | Young et al. |
| 2004/0075610 | A1 | 4/2004 | Pan |
| 2004/0104858 | A1 | 6/2004 | Pfletschinger et al. |
| 2004/0183735 | A1 | 9/2004 | Jecko et al. |
| 2005/0215194 | A1 | 9/2005 | Boling et al. |
| 2006/0097924 | A1 | 5/2006 | Yegin et al. |
| 2006/0103576 | A1 | 5/2006 | Mahmoud et al. |
| 2006/0205369 | A1 | 9/2006 | Schaich et al. |
| 2006/0220970 | A1 | 10/2006 | Aminzadeh et al. |
| 2006/0273969 | A1 | 12/2006 | Aminzadeh et al. |

FOREIGN PATENT DOCUMENTS

| | | | |
|---|---|---|---|
| EP | 0 323 664 | A2 | 12/1988 |
| EP | 0 521 384 | A1 | 1/1993 |
| EP | 1 249 892 | A2 | 10/2002 |
| EP | 1357636 | | 10/2003 |
| EP | 1619752 | | 1/2006 |
| JP | 63004723 | | 9/1988 |
| JP | 2000165135 | | 6/2000 |
| WO | WO 01/03235 | A1 | 1/2001 |

OTHER PUBLICATIONS

Handbook of Microstrip Antennas, 1989, pp. 318-320.

S. Maci and G. Biffi Gentili, "Dual-Frequency Patch Antennas,"IEEE Antennas and Propagation Magazine, Bd. 39, Nr 6, Dec. 1997, pp. 13-20.

"Build This No-Tune Dual-Band Feed for Mode L/S", The Armstrong Journal, Jan./Feb. 2002, 7 pages.

German Patent Office Action dated Jun. 3, 2005 in German Application No. 10 2004 035 064.7-55, filed Jul. 20, 2004 (4 pages).

European Search Report dated Mar. 9, 2006 in European Application No. EP 05 015079.6 (6 pages).

Build This No-Tune Dual-Band Feed for Mode L/S Excerpted From The AMSAT Journal, Jan./Feb. 2002, 10 pages.

* cited by examiner

SINGLE-FEED MULTI-FREQUENCY MULTI-POLARIZATION ANTENNA

CROSS-REFERENCE TO RELATED APPLICATION

This application is a continuation of U.S. application Ser. No. 11/145,878 filed Jun. 6, 2005 now U.S. Pat. No. 7,164,385 the disclosure of which is incorporated herein by reference.

FIELD

The present disclosure relates to antennas for receiving signals of multiple frequencies and multiple polarizations.

BACKGROUND

The statements in this section merely provide background information related to the present disclosure and may not constitute prior art.

In an increasingly wireless world, antennas are becoming ever more prevalent. This is particularly true in automobiles, which typically include antennas for one or more of AM radio, FM radio, satellite radio, cellular phones, and GPS. These signals are of different frequencies and polarizations. For example, the signals associated with satellite radio (e.g. brand names XM and Sirius) are in the range of 2.320 to 2.345 GHz and are left hand circularly polarized (LHCP); and the signals associated with global positioning systems (GPS) are in the range of 1.574 to 1.576 GHz and are right hand circularly polarized (RHCP).

Antenna packages have been developed in which multiple antennas receive and output multiple signals on multiple feeds. However, these packages are undesirably complex and expensive, and the multiple feeds are undesirable. While these antenna packages have proven effective and popular, there is an ever increasing need for antennas of increasingly simple, compact, and low-cost design.

SUMMARY

Various exemplary embodiments provide antennas capable of receiving both left-hand circularly polarized (LHCP) signals and right-hand circularly polarized (RHCP) signals, and outputting both signals on a single feed. In one such embodiment, an antenna generally includes an inner patch and an outer patch. The outer patch is substantially coplanar and substantially concentric with the inner patch. A gap is defined generally between the inner and outer patches such that the inner and outer patches are separated and do not physically contact each other. A single feed is connected to the inner patch. The outer patch does not have a feed connected thereto and is parasitically fed. The inner patch is operable, independently from the outer patch, for receiving left hand circularly polarized (LHCP) signals. The inner and outer patches are operable collectively together for receiving right hand circularly polarized (RHCP) signals. Accordingly, the antenna is operable for outputting two different signals having different frequencies and different polarizations on the single feed.

In another exemplary embodiment, an antenna generally includes a first substantially planar antenna element and a second substantially planar antenna element surrounding the first antenna element. The first and second antenna elements are substantially coplanar. A feed is connected to only one of the first and second antenna elements. The other one of the first and second antenna elements does not have a feed connected thereto and is parasitically fed. At least two signals having different frequencies and different polarizations may appear on the feed.

In a further exemplary embodiment, an antenna generally includes a first antenna element adapted to receive a first signal having a first frequency and a first polarization. The antenna also includes a second antenna element adapted to receive a second signal having a second frequency different from the first frequency and a second polarization different from the first polarization. A single feed is connected to only one of the first and second antenna elements. The other one of the first and second antenna elements does not have a feed connected thereto and is parasitically fed. The first and second signals appear on the feed.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
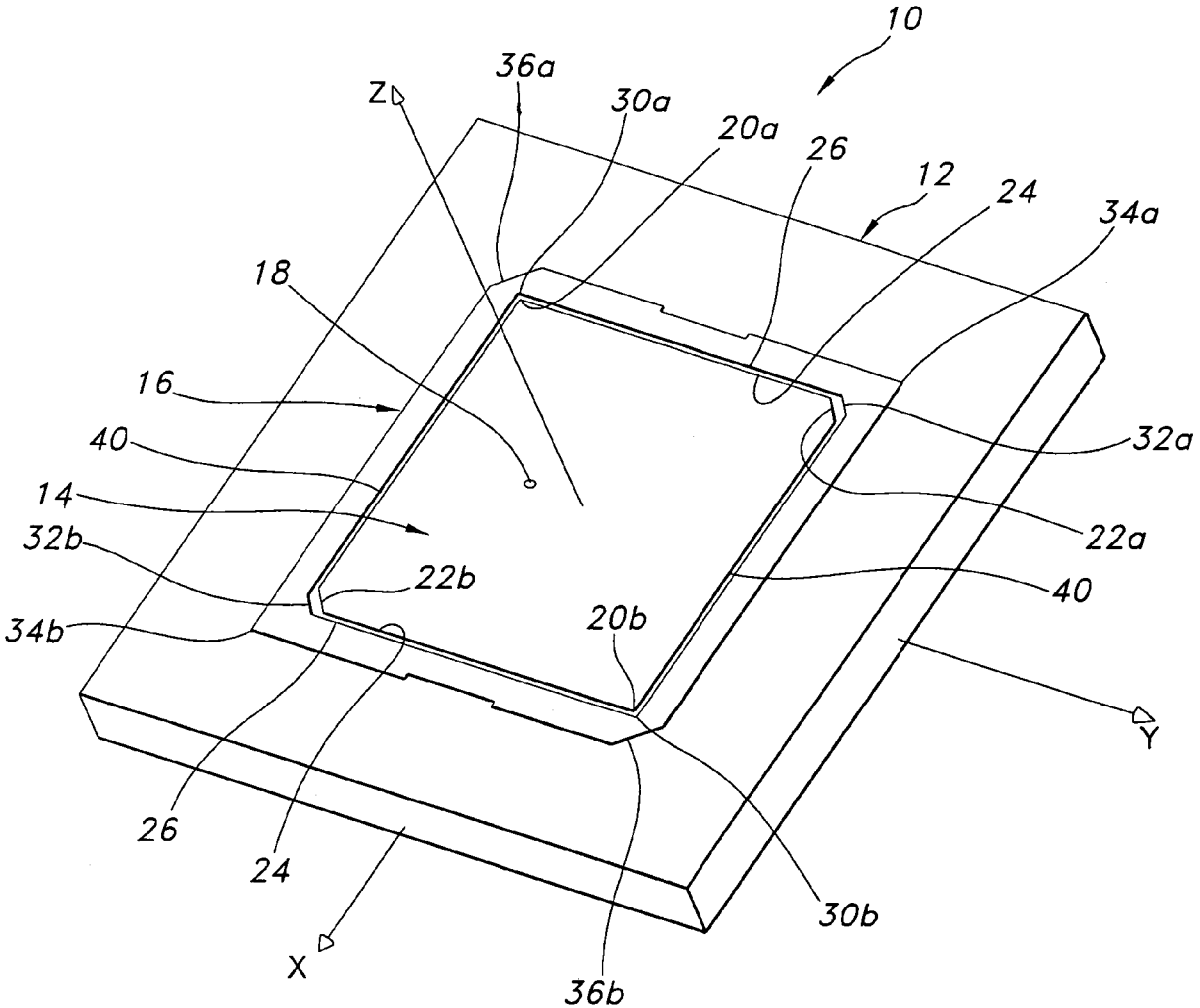
FIG. 1 is a top perspective view of an antenna according to exemplary embodiments.

The following description is merely exemplary in nature and is not intended to limit the present disclosure, application, or uses. It should be understood that throughout the drawings, corresponding reference numerals indicate like or corresponding parts and features.

Various exemplary embodiments provide antennas capable of receiving both left-hand circularly polarized (LHCP) signals and right-hand circularly polarized (RHCP) signals, and outputting both signals on a single feed. In one such embodiment, an antenna generally includes an inner patch and an outer patch. The outer patch is substantially coplanar and substantially concentric with the inner patch. A gap is defined generally between the inner and outer patches such that the inner and outer patches are separated and do not physically contact each other. A single feed is connected to the inner patch. The outer patch does not have a feed connected thereto and is parasitically fed. The inner patch is operable, independently from the outer patch, for receiving left hand circularly polarized (LHCP) signals. The inner and outer patches are operable collectively together for receiving right hand circularly polarized (RHCP) signals. Accordingly, the antenna is operable for outputting two different signals having different frequencies and different polarizations on the single feed.

In another exemplary embodiment, an antenna generally includes a first substantially planar antenna element and a second substantially planar antenna element surrounding the first antenna element. The first and second antenna elements are substantially coplanar. A feed is connected to only one of the first and second antenna elements. The other one of the first and second antenna elements does not have a feed connected thereto and is parasitically fed. At least two signals having different frequencies and different polarizations may appear on the feed.

In a further exemplary embodiment, an antenna generally includes a first antenna element adapted to receive a first signal having a first frequency and a first polarization. The antenna also includes a second antenna element adapted to receive a second signal having a second frequency different from the first frequency and a second polarization different from the first polarization. A single feed is connected to only one of the first and second antenna elements. The other one of the first and second antenna elements does not have a feed connected thereto and is parasitically fed. The first and second signals appear on the feed.

In some embodiments, an antenna includes a single probe feed to achieve circular polarization, which is unlike those antennas in which two probes are fed ninety degrees out of phase to achieve circular polarization. In some embodiments, an inner patch is fed directly by a probe and operates at specific frequency and polarization, while the outer patch that is parasitically fed (i.e., no probe is attached to it) operates at a different frequency and a different polarization. In some embodiments, there are chamfered corners of the inner and outer patches to achieve dual frequency, dual polarization operation on a single feed.

Embodiments of antennas as disclosed herein may achieve different bands of operation and different circular polarizations simultaneously using only one probe feed. This is unlike some existing antennas in which there are inner and outer patches having the same polarization while operating at different frequency bands, where circular polarization is achieved by attaching two probes to the inner patch that are fed ninety degrees out of phase.

In one exemplary embodiment, an antenna includes coplanar inner and outer patches. The outer patch surrounds the inner patch. The two patches are physically spaced apart from each other by a gap. A single feed is connected to the inner patch. The inner patch resonates at a first frequency with a first antenna polarization sense. The outer patch resonates at a second frequency with a second polarization sense. The first and second frequencies are different. The first and second antenna polarization senses can be the same or different. Both signals are outputted on the single feed. In some embodiments, the two patches are metalized layers on a substrate.

Accordingly, embodiments of the present disclosure may be relatively simple and inexpensive, yet highly effective and efficient. They may also enable signals of different frequencies and different polarizations to be outputted on a single feed. Such embodiments may provide lower-cost, simpler, and more compact designs than those existing antenna packages in which multiple antennas receive and output multiple signals on multiple feeds.

Figure 2:
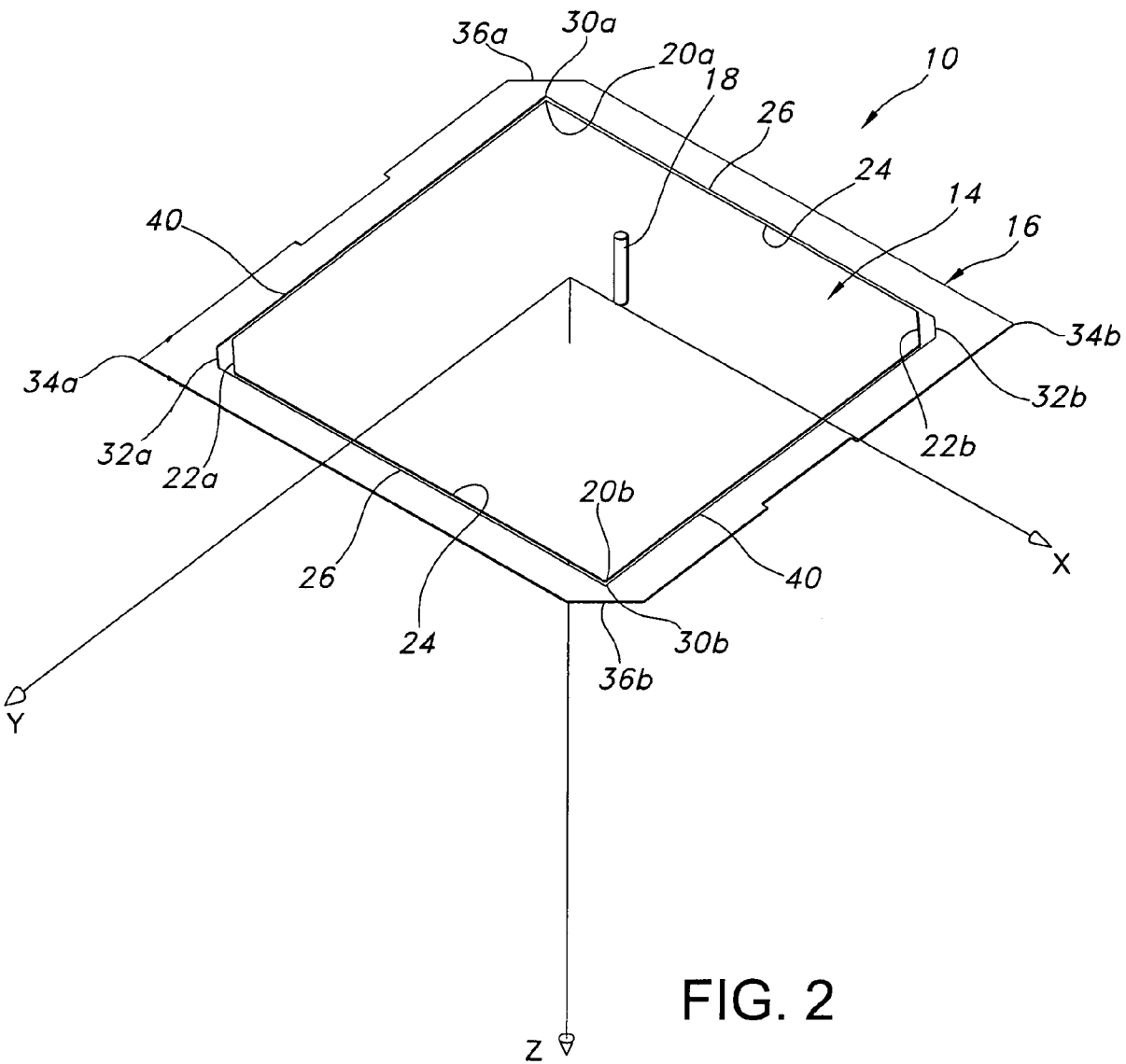
FIG. 2 is a bottom perspective view of the antenna shown in FIG. 1 but not showing the substrate.
Figure 3:
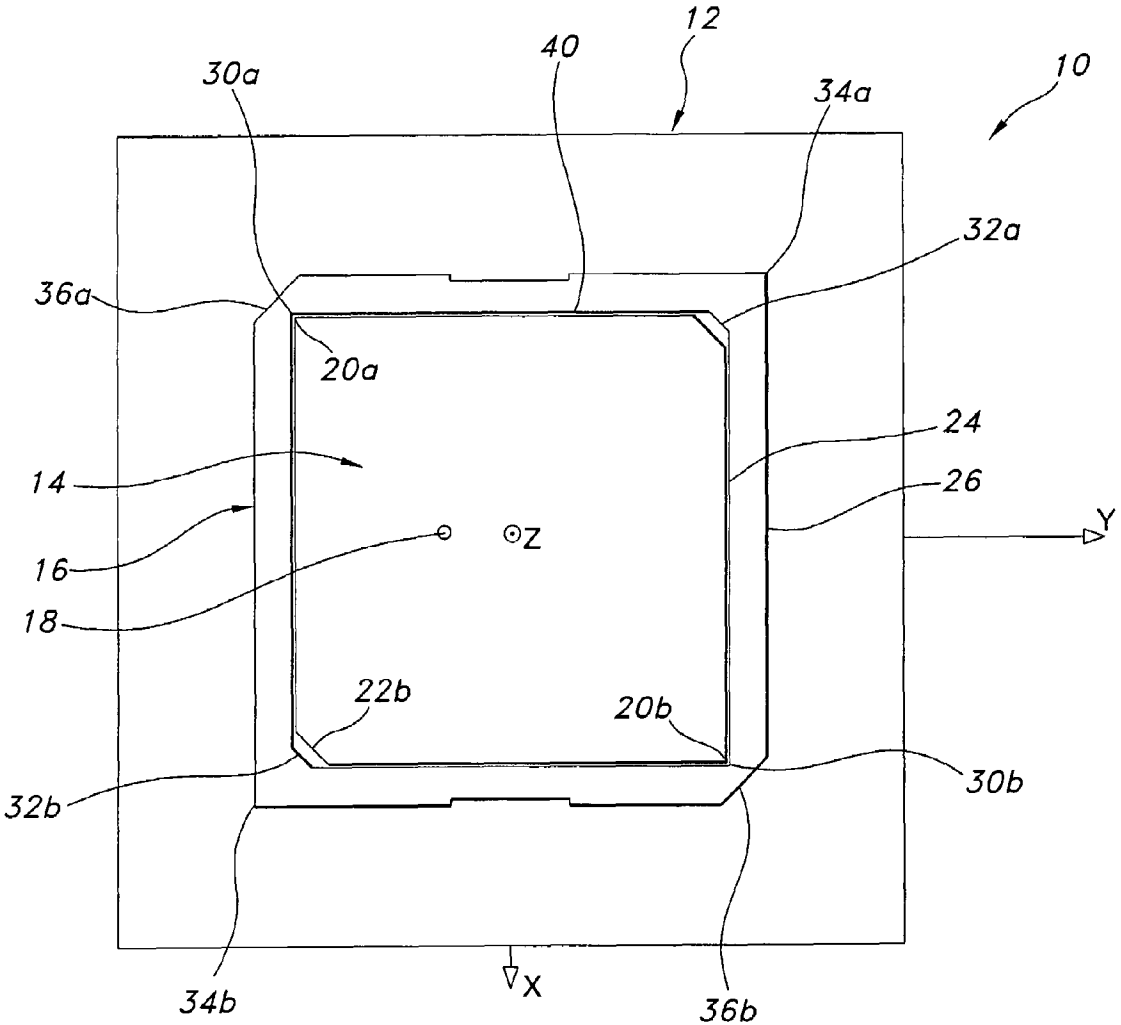
FIG. 3 is a top plan view of the antenna shown in FIG. 1.

FIGS. 1 through 3 illustrate an antenna 10 constructed in accordance with a current embodiment. The antenna 10 includes a substrate 12, an inner patch 14, an outer patch 16, and a single feed or lead 18. The inner and outer patches 14 and 16 are mounted on the substrate 12. The single feed 18 extends through the substrate 12 and is connected to the inner patch 14. The inner patch 14 receives a signal having a first frequency and a first polarization, and the inner and outer patches 14 and 16 together receive signals having a second frequency and a second polarization. The first and second frequencies are different, as are the first and second polarizations.

Both signals are outputted on the single feed 18. The substrate 12 is known to those skilled in the antenna art. The substrate 12 may be fabricated of any suitable electrically nonconductive material, such as plastic or ceramic. The substrate 12 supports the remaining elements of the antenna 10.

The directions X, Y, and Z are included in FIGS. 1 through 3 to provide clarity of orientation among the three views. The X and Y axes lie within the plane of the two coplanar patches 14 and 16. The Z axis is perpendicular to the plane of the patches, and extends through the center of the patches.

The inner patch 14 is substantially or generally square when viewed in plan view (see particularly FIG. 3). As a square, it has four corners 20*a*, 20*b*, 22*a*, and 22*b*. Two diagonally opposite corners 20*a* and 20*b* are substantially square, and the other two diagonally opposite corners 22*a* and 22*b* are substantially non-square as is conventional for antennas for circularly polarized signals. In the current embodiment, the corners 22*a* and 22*b* are cut at a forty-five degree angle to the sides of the inner patch 14. Other appropriate techniques for non-squaring the corners 22*a* and 22*b* are and will be known to those skilled in the art.

The outer patch 16 is shaped like a picture frame about the inner patch 14. The outer frame 16 has a substantially square inner edge 24 and a substantially square outer edge 26. The two edges 24 and 26 are substantially concentric.

The inner edge 24 of the outer patch 16 is substantially square and includes four corners 30*a*, 30*b*, 32*a*, and 32*b*. Two diagonally opposite corners 30*a* and 30*b* are substantially square, and the other two diagonally opposite corners 32*a* and 32*b* are substantially not square. The non-square corners 32*a* and 32*b* are proximate or adjacent to the non-square corners 22*a* and 22*b* on the inner patch 14.

The outer edge 26 of the outer patch 16 also is substantially square and includes four corners 34*a*, 34*b*, 36*a*, and 36*b*. Two diagonally opposed corners 34*a* and 34*b* are substantially square, and the other two diagonally opposed corners 36*a* and 36*b* are substantially not square. The non-square corners 36*a* and 36*b* are remote from the non-square corners 22*a* and 22*b* of the inner patch 14. Like the non-square corners of the inner patch, the non-square corners 32*a*, 32*b*, 36*a*, and 36*b* are angled at forty-five degrees relative to the sides of the square inner edge 24. Other appropriate shapes are and will be known to those skilled in the art.

The inner edge 24 of the outer patch 16 is spaced from the inner patch 14. Additionally, the two patches 14 and 16 are positioned concentrically about a common center axis 2. Therefore, the patches 14 and 16 define a gap 40 therebetween so that the patches 14 and 16 are physically separate from one another. The width of the gap is substantially uniform about the perimeter of the inner patch 14. The gap widens in the areas of the corners 22*a*, 22*b*, 32*a*, and 32*b*.

In the current embodiment, the patches 14 and 16 are metalized layers formed directly on the substrate 12. Each patch is substantially planar; and the two patches are substantially coplanar.

The relative size, shape, and orientations of the patches 14 and 16 can be tuned through a trial-and-error process. The patches 14 and 16 shown in the drawings illustrate the current embodiment, which has been tuned to provide a balance among the performance factors. Those skilled in the art will recognize that the patches can be tuned differently to achieve different balances among the performance factors.

The single feed 18 is connected only to the inner patch 14. The feed 18 extends 10 through the substrate 12. The feed 18 is connected off center of the inner patch 14 as is conventional for antennas for circularly polarized signals.

OPERATION

The antenna 10 outputs two different signals having different frequencies and different polarizations on the single feed 18. The inner patch 14 operates independently to receive left hand circularly polarized (LHCP) signals, for example, those associated with satellite radio. The patches 14 and 16 together operate to receive right hand circularly polarized (RHCP) signals, for example, those associated with GPS signals.

Figure 4:
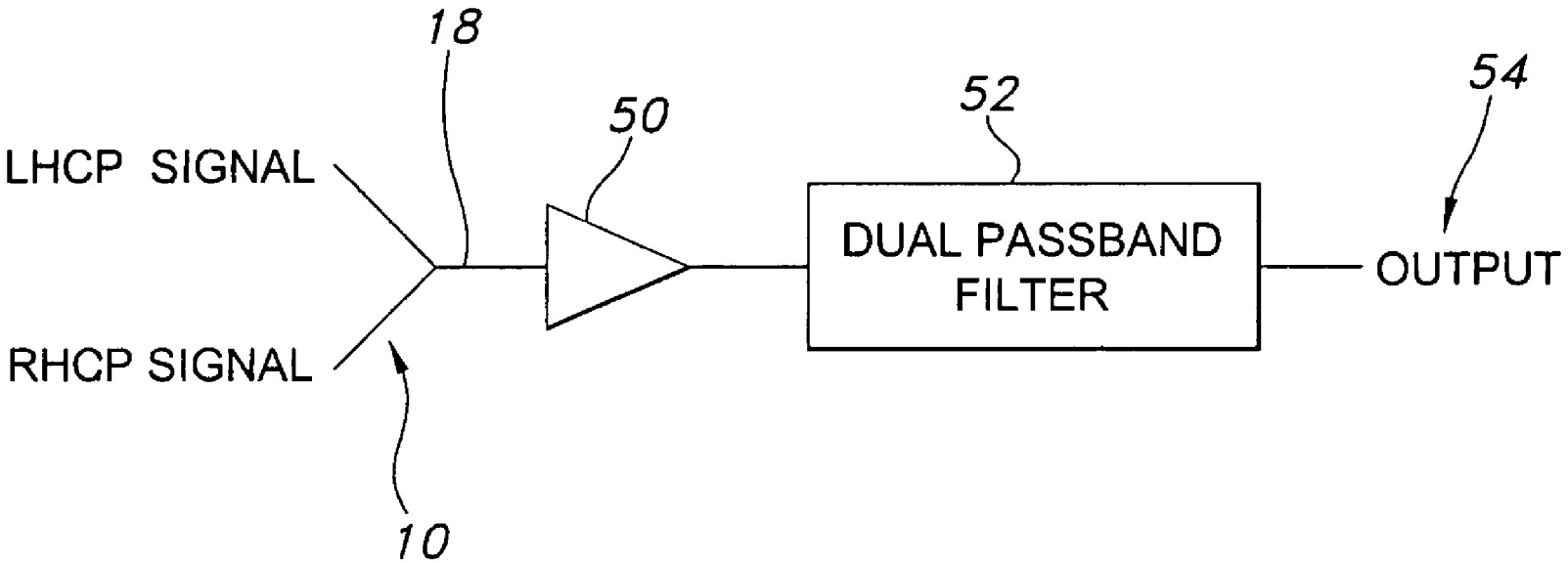
FIG. 4 is a schematic diagram of the antenna shown in FIG. 1 and the signal processing components contemplated for attachment thereto.

FIG. 4 is a schematic diagram showing the antenna 10 connected to an amplifier 50 and a dual passband filter 52. The amplifier 50 can be of any suitable design known to those skilled in the art. Similarly, the dual passband filter 52 can be of any suitable design known to those skilled in the art. When the antenna 10 is for satellite radio signals and GPS signals, the two passbands are in the range of 2.320 to 2.345 GHz for the satellite radio signal, and in the range of 1.574 to 1.576 GHz for the GPS signal. The output 54 of the dual passband filter 52 may be fed to a satellite radio receiver and/or a GPS unit.

Figure 5:
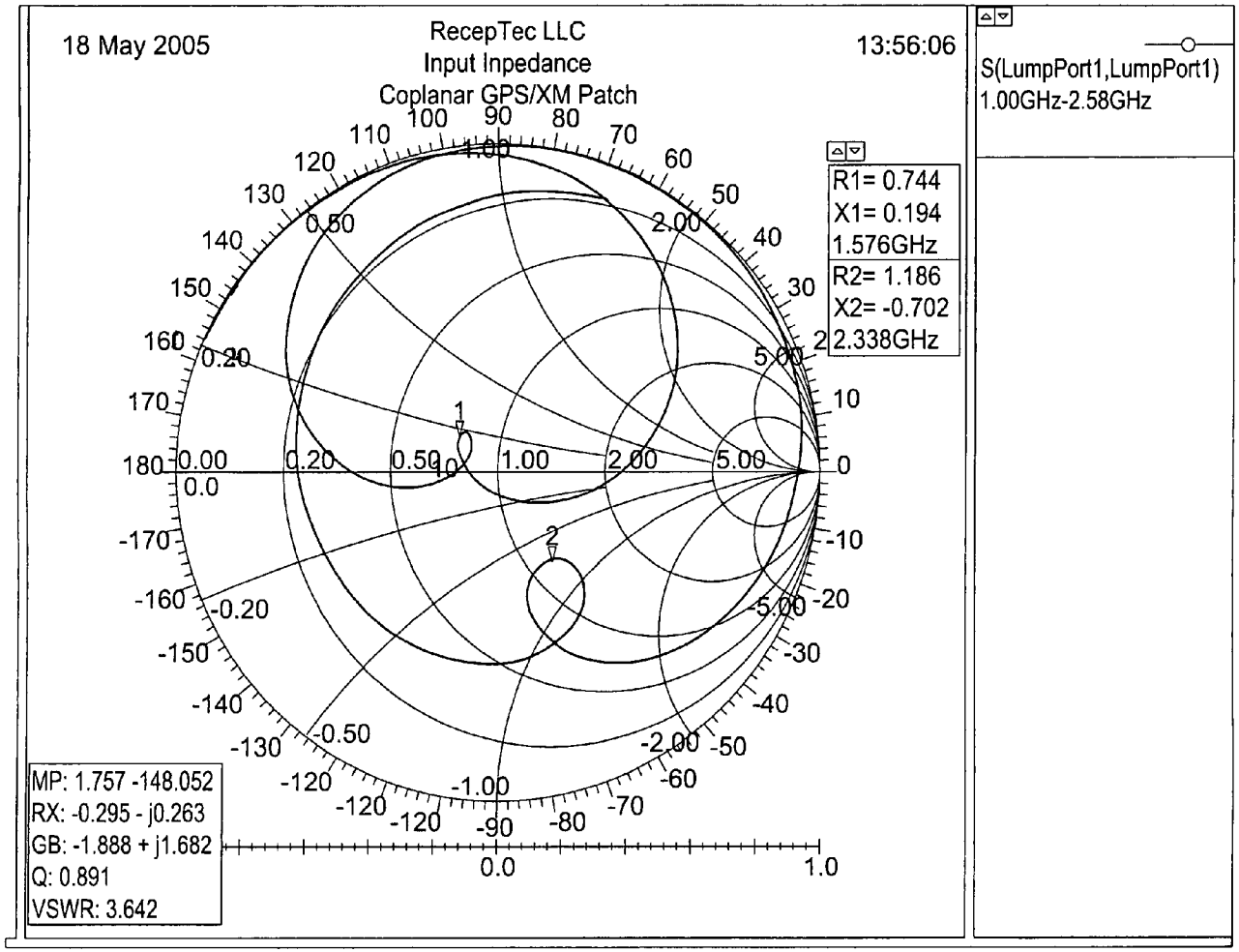
FIGS. 5 through 14 are plots and charts illustrating the performance of the antenna shown in FIG. 1.

FIGS. 5 through 14 are plots and charts illustrating the performance of the antenna of the current embodiment. FIG. 5 is a Smith chart showing the impedance of the coplanar patches. This charts shows that the coplanar patches have a dual resonance with a circularly polarized sense at each resonance. (One cannot tell what the polarization sense is from the impedance, but can tell if it is circular or linear.) The markers R1, X1 and R2, X2 represent the real and imaginary impedance parts at the GPS and XM bands, respectively. The impedance values are normalized with respect to 50 ohms.

Figure 6:
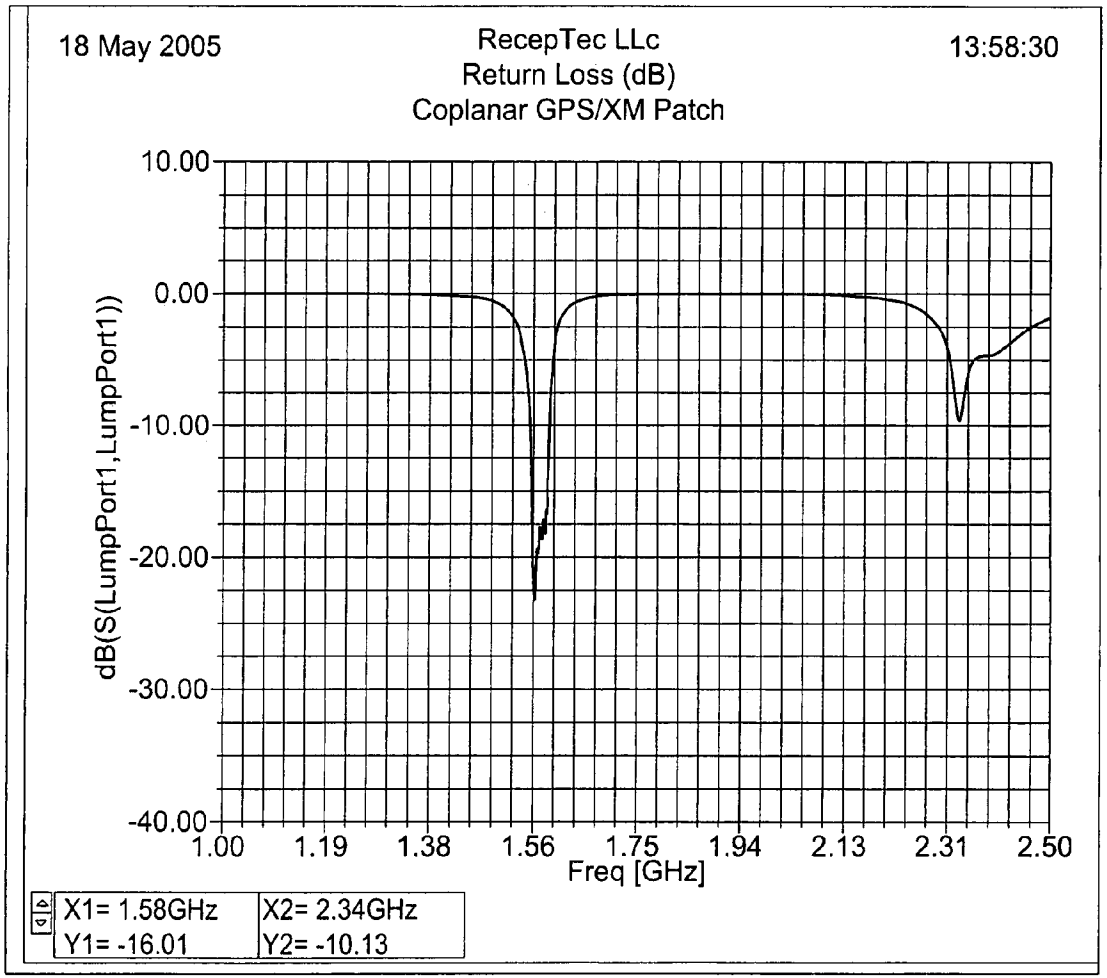

FIG. 6 illustrates the return loss of the coplanar patches in decibels (dB). The plot shows that at both resonance frequencies the antenna can be matched well (greater than 10 dB in return loss) for practical applications. The markers X1, Y1 and X2, Y2 represent the frequency of resonance and the return loss in dB, respectively.

Figure 7:
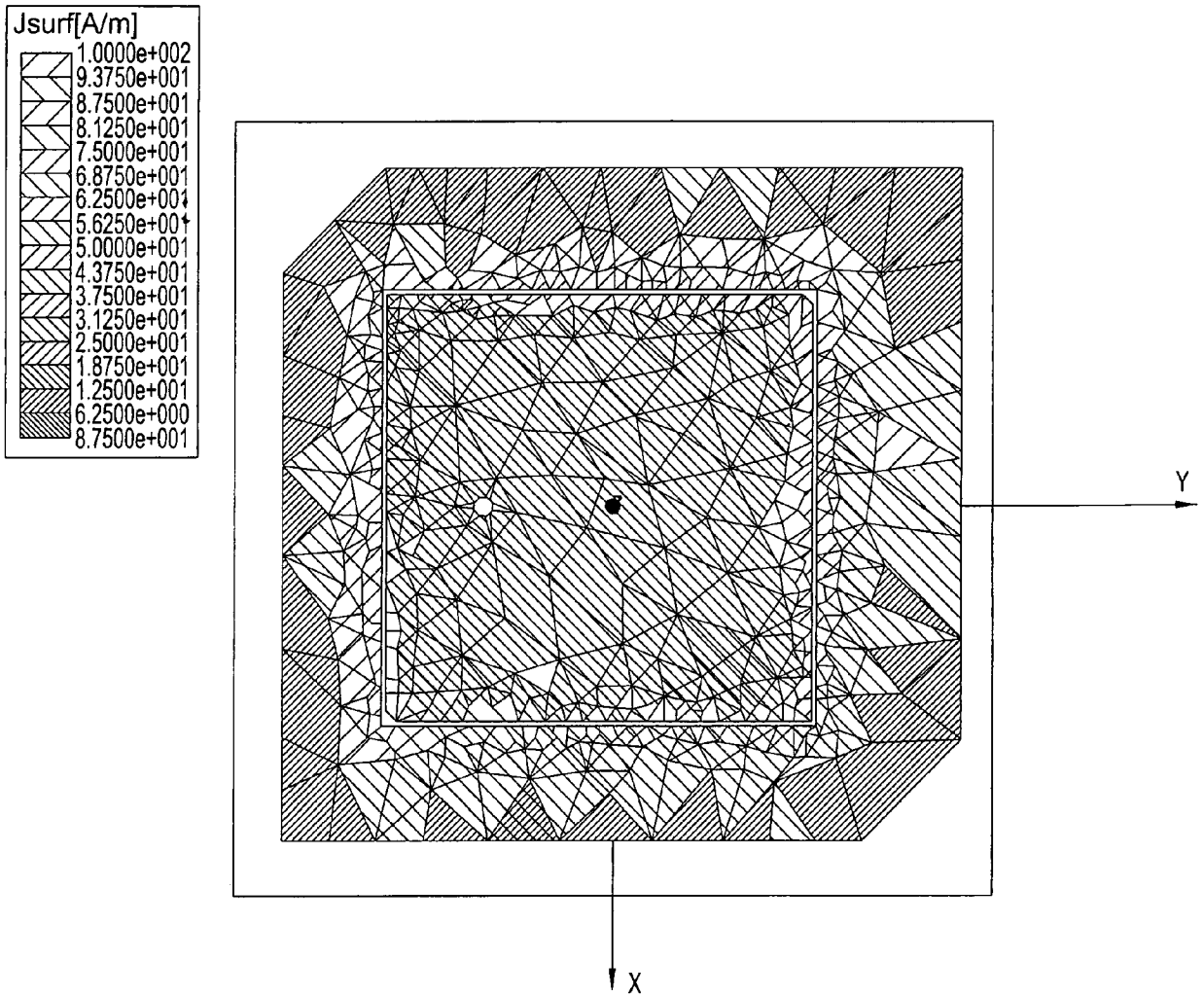

FIG. 7 is an illustration of the surface RF current distribution on the metallization of the coplanar patches in the XM frequency range. White corresponds to maximum surface current, while black corresponds to minimum surface current. The resonating structure is the inner patch with the chamfered corners being the 'hot spots,' where the illustration indicates that the current distribution gives a LHCP radiation based on the probe location with respect to the chamfered edges. In addition, the outer patch is not resonating as evidenced by the fact that the surface current distribution on the outer patch is minimal.

Figure 8:
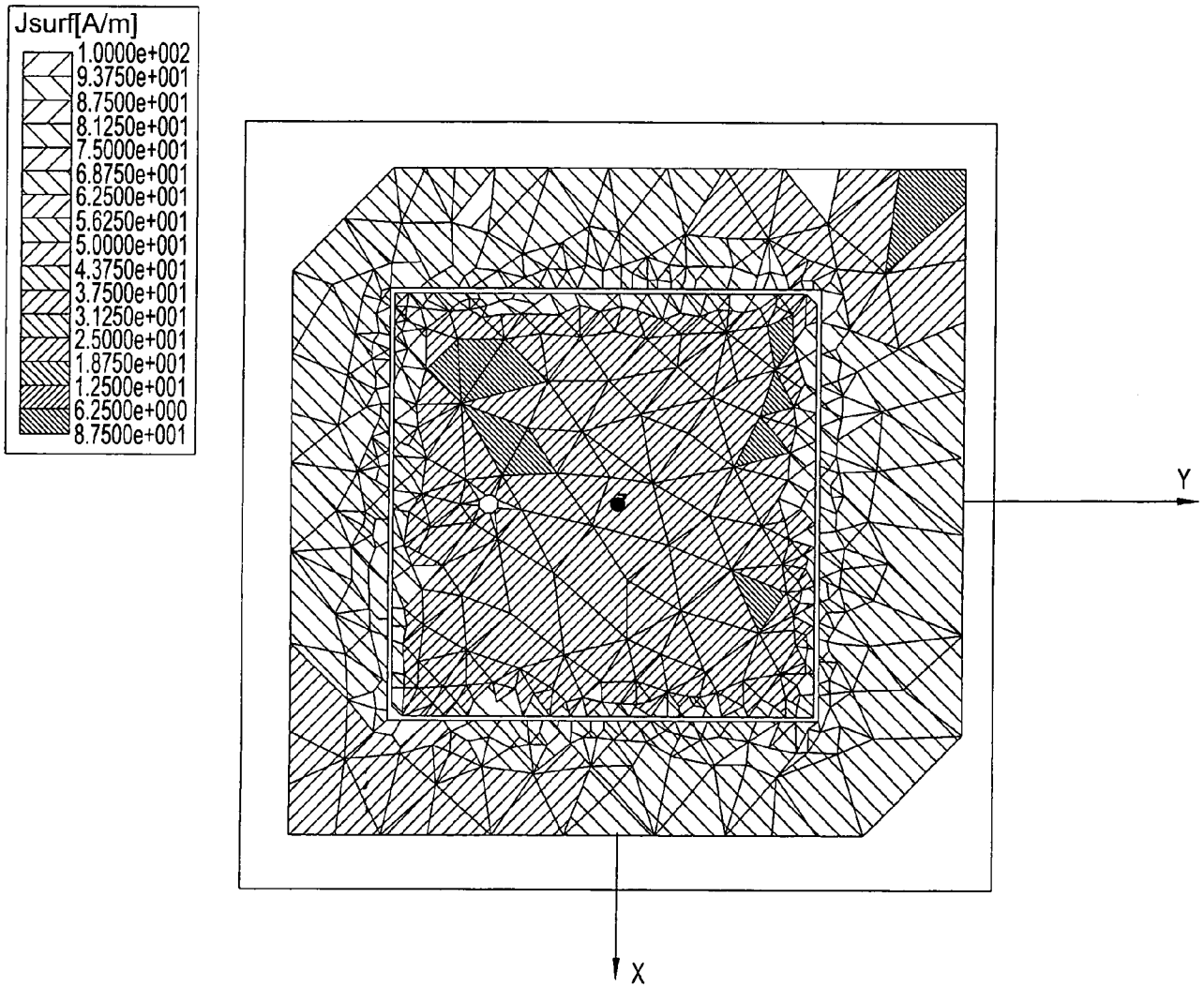

FIG. 8 is an illustration of the surface RF current distribution on the metallization of the coplanar patches in the GPS frequency range. Again, white corresponds to maximum surface current, while black corresponds to minimum surface current. The resonating structure is the outer patch with the chamfered corners being the 'hot spots,' where the illustration indicates that the current distribution gives a RHCP radiation based on the probe location with respect to the chamfered edges. In addition, the inner patch is not resonating as evidenced by the fact that the surface current distribution on the inner patch is minimal.

Figure 9:
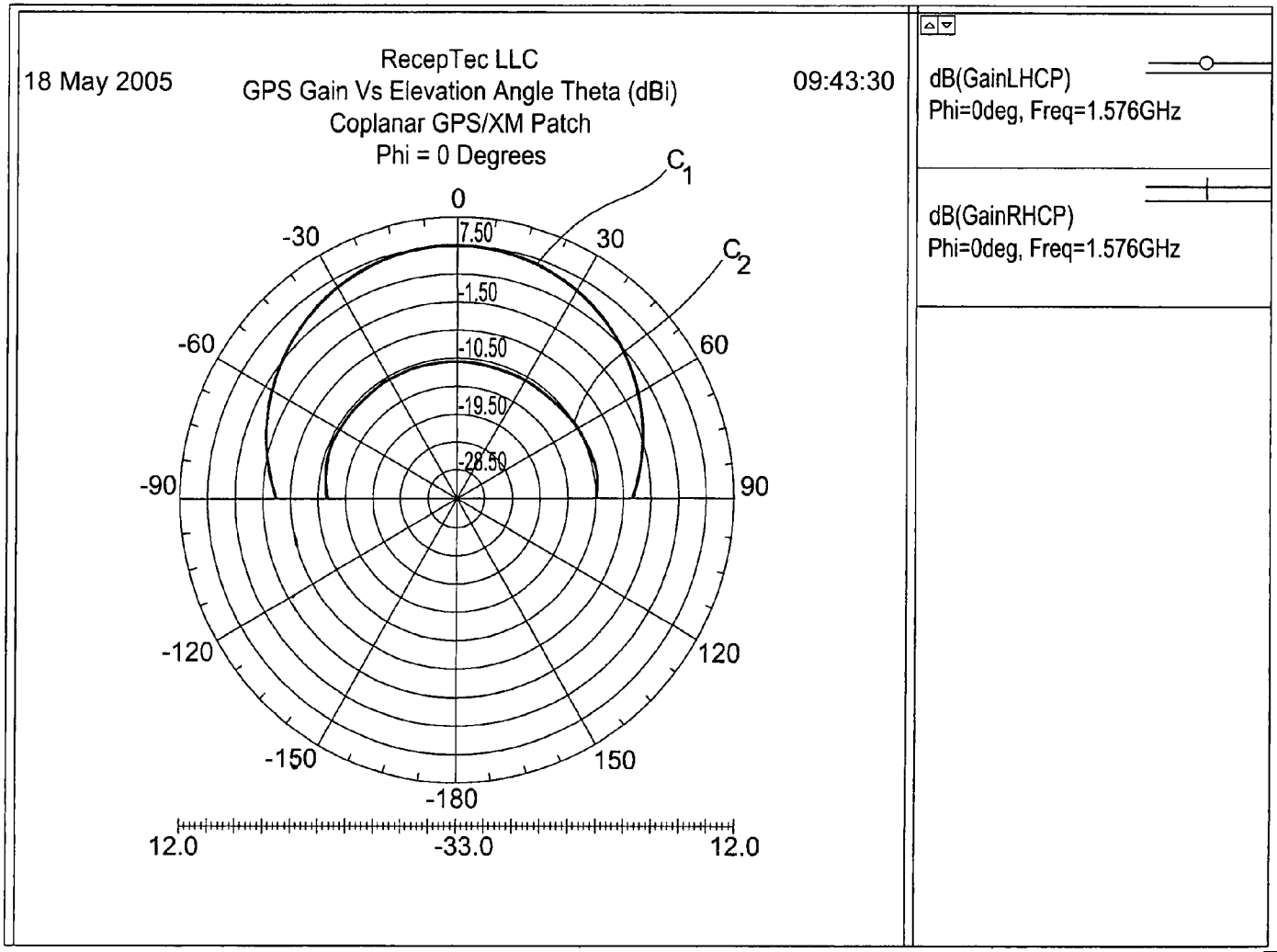

FIG. 9 shows the coplanar patch radiation pattern in the GPS frequency range. Gain is shown in dBic (antenna gain, decibels referenced to a circularly polarized, theoretical isotropic radiator). The curve C1 is RHCP, named the co-polarization of the antenna. The curve C2 is the LHCP, named the cross-polarization of the antenna). The RHCP is much higher in amplitude than the LHCP. This radiation pattern cut is called gain as a function of the elevation angle theta (θ), which in spherical coordinates is measured for the positive z-axis shown in FIG. 2. Maximum gain occurs at theta equal to zero degrees, which is also called the boresight of the antenna. This is a typical radiation pattern for a patch antenna. In addition, this particular cut is at azimuth angle phi (Φ) at zero degrees. Phi is measured from the positive x-axis shown in FIG. 2.

Figure 10:
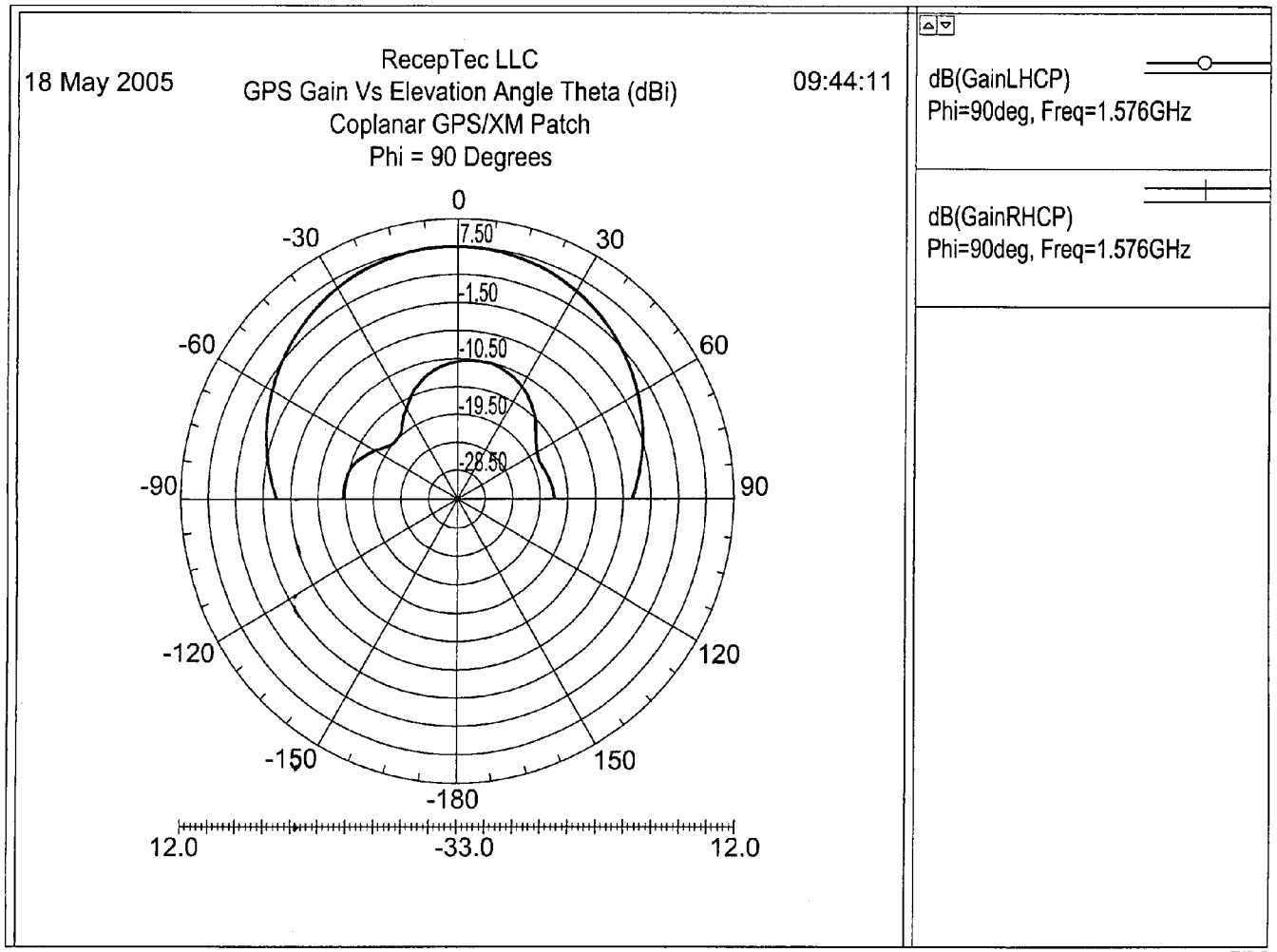

FIG. 10 is similar to FIG. 9, except that the azimuth angle phi is equal to ninety degrees. The maximum co-polarization RHCP occurs at the boresight of the antenna.

Figure 11:
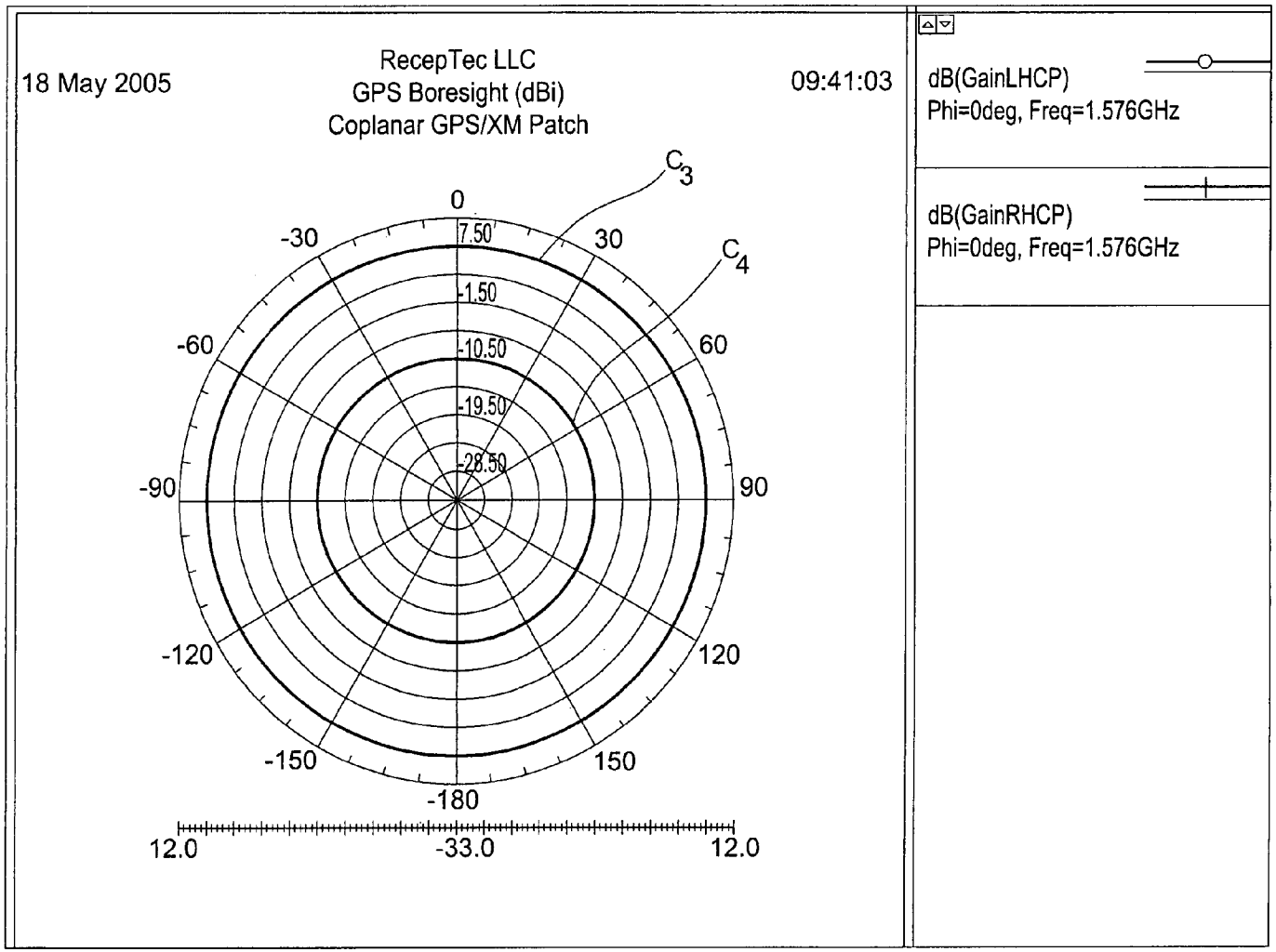

FIG. 11 shows gain as a function of the azimuth angle phi at elevation angle theta equal to zero (i.e., at the boresight) in the GPS frequency range. The curve C3 is RHCP, and the curve C4 is LHCP. The RHCP (co-polarization) is at least 17.5 dB higher than the LHCP (cross-polarization), suggesting that the antenna at the GPS frequency range is right-hand circularly polarized.

Figure 12:
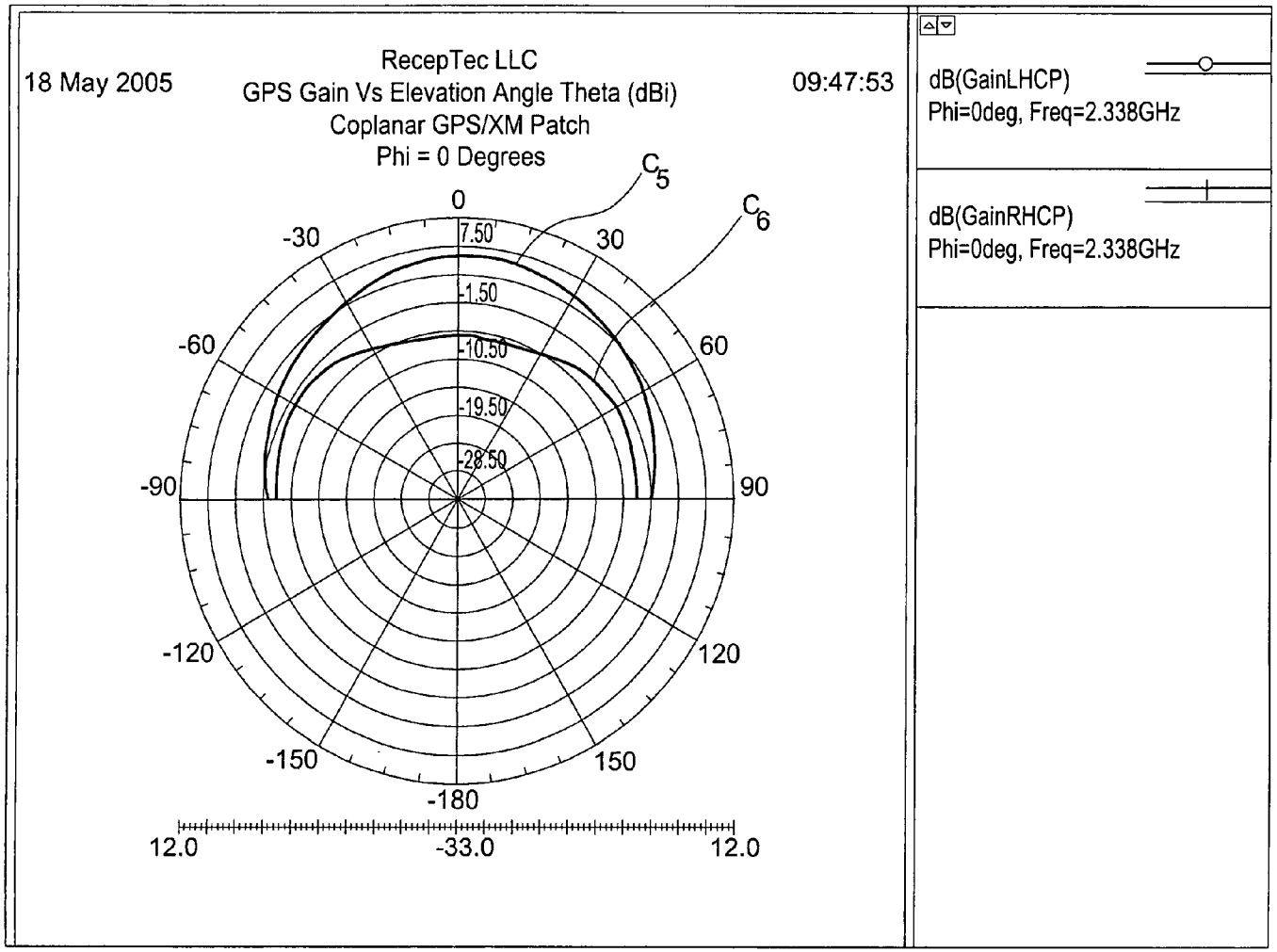

FIG. 12 shows radiation pattern (gain in dBic) in the XM frequency range. The curve C5 is LHCP, named the co-polarization of the antenna. The curve C6 is the RHCP, named the cross-polarization of the antenna. The LHCP is much higher in amplitude than the RHCP. This radiation pattern cut is again called "gain as a function of the elevation angle theta (θ)". Maximum gain occurs at theta equal to zero degrees, which is also the boresight of the antenna. Again, this is a typical radiation pattern of a patch antenna. In addition, this cut is at azimuth angle phi (Φ) at zero degrees.

Figure 13:
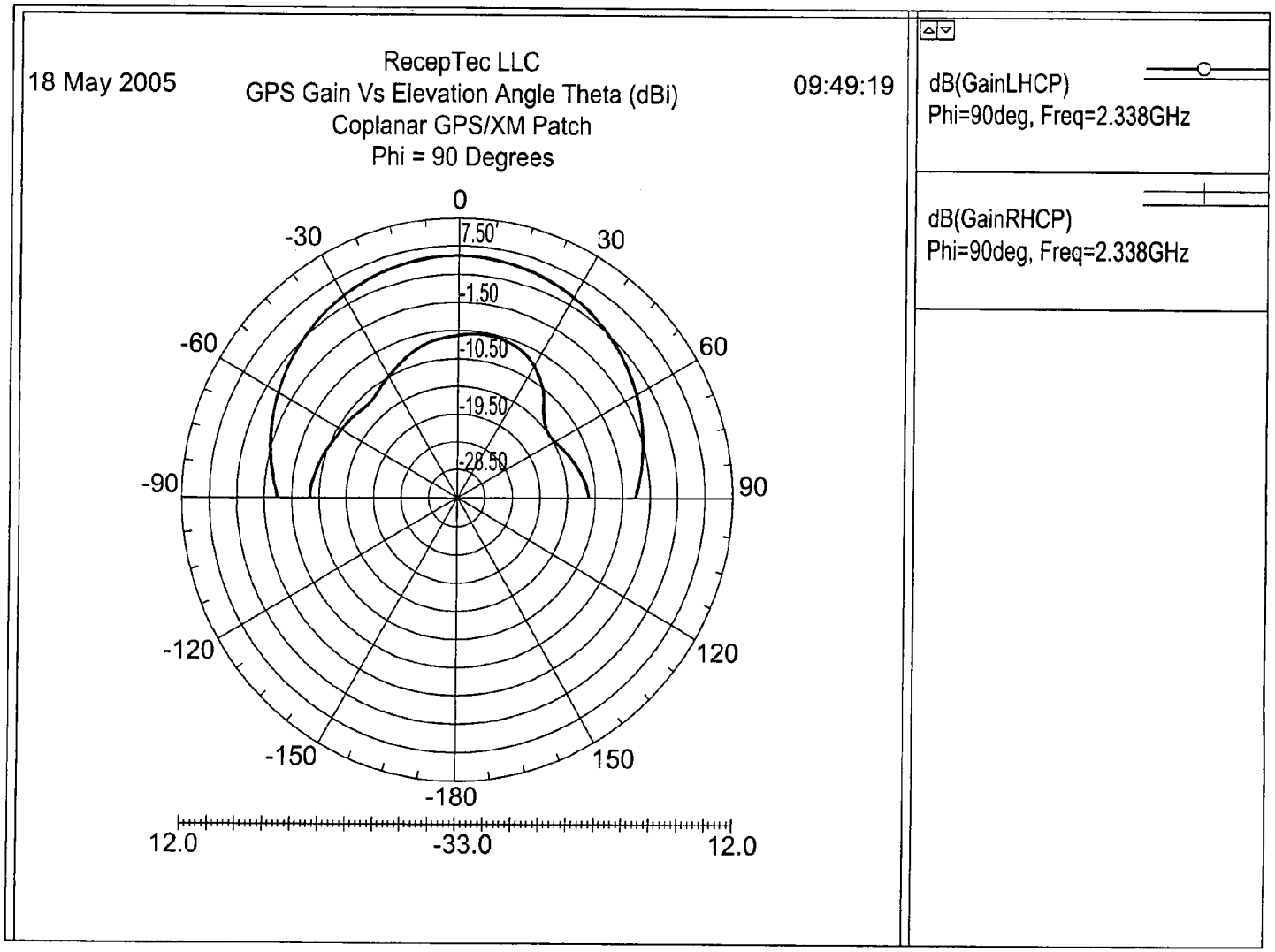

FIG. 13 is similar to FIG. 12, except that the azimuth angle phi is equal to ninety degrees. The maximum co-polarization LHCP occurs at the boresight of the antenna.

Figure 14:
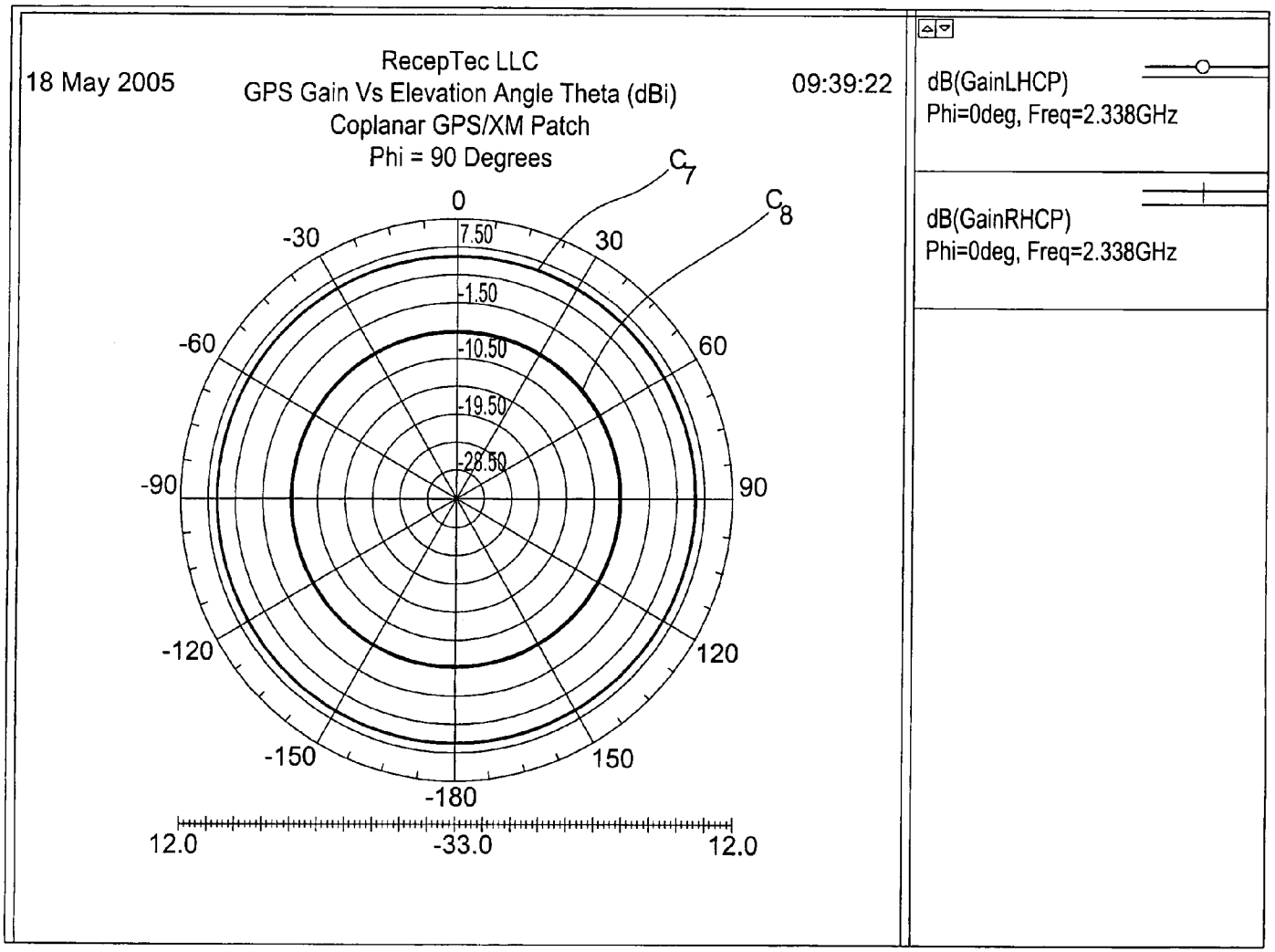

FIG. 14 shows gain as a function of the azimuth angle phi at elevation angle theta equal to zero (i.e., at boresight) in the XM frequency range. The curve C7 is LHCP, and the curve C8 is LHCP. The LHCP (co-polarization) is at least 13 dB higher than the RHCP (cross-polarization) suggesting that the antenna is left-hand circularly polarized.

It should be noted that embodiments and aspects of the present disclosure may be used in a wide range of antenna applications, such as patch antennas, telematics antennas, antennas configured for receiving satellite signals (e.g., Satellite Digital Audio Radio Services (SDARS), Global Positioning System (GPS), cellular signals, etc.), terrestrial signals, antennas configured for receiving RF energy or radio transmissions (e.g., AM/FM radio signals, etc.), combinations thereof, among other applications in which wireless signals are communicated between antennas. Accordingly, the scope of the present disclosure should not be limited to only one specific form/type of antenna assembly.

In addition, various antenna assemblies and components disclosed herein may be mounted to a wide range of supporting structures, including stationary platforms and mobile platforms. For example, an antenna assembly disclosed herein could be mounted to supporting structure of a bus, train, aircraft, bicycle, motor cycle, among other mobile platforms. Accordingly, the specific references to motor vehicles herein should not be construed as limiting the scope of the present disclosure to any specific type of supporting structure or environment.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "the" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An antenna capable of receiving both left-hand circularly polarized (LHCP) signals and right-hand circularly polarized (RHCP) signals, and outputting both signals on a single feed, the antenna comprising:

an inner patch;

an outer patch substantially coplanar and substantially concentric with the inner patch, a gap defined generally between the inner and outer patches such that the inner and outer patches are separated and do not physically contact each other;

a single feed connected to the inner patch, the outer patch not having a feed connected thereto and being parasitically fed;

whereby the inner patch is operable, independently from the outer patch, for receiving left hand circularly polarized (LHCP) signals, and the inner and outer patches operable collectively together for receiving right hand circularly polarized (RHCP) signals such that the antenna is operable for outputting two different signals having different frequencies and different polarizations on the single feed.

2. An antenna capable of receiving both left-hand circularly polarized (LHCP) signals and right-hand circularly polarized (RHCP) signals, and outputting both signals on a single feed, the antenna comprising:

an inner patch, the inner patch is substantially square and having four corners, two of the corners diagonally opposite one another being non-square;

an outer patch substantially coplanar and substantially concentric with the inner patch, a gap defined generally between the inner and outer patches such that the inner and outer patches are separated and do not physically contact each other, the outer patch includes an inner edge and an outer edge each being substantially square and having four corners, the inner and outer edges being substantially concentric, two of the corners on each of the inner and outer edges diagonally opposite one another being non-square, the two corners of the inner edge being adjacent the two corners of the inner patch, the two corners of the outer edge being remote from the two corners of the inner patch; and a single feed connected to the inner patch, the outer patch not having a feed connected thereto and being parasitically fed;

whereby the inner patch is operable; independently from the outer patch, for receiving left hand circularly polarized (LHCP) signals, and the inner and outer patches operable collectively together for receiving right hand circularly polarized (RHCP) signals such that the antenna is operable for outputting two different signals having different frequencies and different polarizations on the single feed.

3. An antenna comprising:

a first substantially planar antenna element;

a second substantially planar antenna element surrounding the first antenna element, the first and second antenna elements being substantially coplanar, and a gap defined between an outer edge of the first antenna element and an inner edge of the second antenna element such that the first and second antenna elements are separated and do not physically contact each other; and a feed connected to only one of the first and second antenna elements with the other one of said first and second antenna elements not having a feed connected thereto and being parasitically fed, whereby at least two signals having different frequencies and different polarizations appear on the feed.

4. The antenna of claim 3, wherein the antenna is operable for achieving different bands of operation and different circular polarizations simultaneously using only one feed.

5. The antenna of claim 3, wherein the different polarizations are circular polarizations.

6. The antenna of claim 3, wherein:

the first antenna element is substantially square; and the second antenna element includes a substantially square inner edge and a substantially square outer edge.

7. The antenna of claim 6, wherein the first antenna element and the inner edge of the second antenna element define a gap of substantially uniform width.

8. The antenna of claim 3, wherein the feed is connected to the first antenna element.

9. The antenna of claim 8, wherein the second antenna element is parasitically fed without any feed connected to the second antenna element.

10. The antenna of claim 9, wherein the first antenna element is operable, independently from the second antenna element, for receiving left hand circularly polarized (LHCP) signals, and wherein the first and second antenna elements are operable collectively for receiving right hand circularly polarized (RHCP) signals.

11. The antenna of claim 9, wherein the first antenna element is operable, independently from the second antenna element, for receiving signals associated with a Global Positioning System (GPS), and wherein the first and second antenna elements are operable collectively together for receiving signals associated with a Satellite Digital Audio Radio Service (SDARS).

12. An antenna comprising:

a first substantially planar and substantially square antenna element, the first antenna element having four corners, two of the corners diagonally opposite one another being non-squares;

a second substantially planar antenna element surrounding the first antenna element, the first and second antenna elements being substantially coplanar, the second antenna element includes a substantially square inner edge and a substantially square outer edge, each of the inner and outer edges of the second antenna element including four corners, two of the corners on each of the inner and outer edges diagonally opposite one another being non-square, the two corners of the inner edge being adjacent the two corners of the first antenna element, the two corners of the outer edge being remote from the two corners of the first antenna element; and a feed connected to only one of the first and second antenna elements with the other one of said first and second antenna elements not having a feed connected thereto and being parasitically fed, whereby at least two signals having different frequencies and different polarizations appear on the feed.

13. The antenna of claim 12, wherein the first and second antenna elements are physically separated from each other by a gap defined therebetween.

14. The antenna of claim 13, wherein the first antenna element is substantially square having four corners, two of the corners diagonally opposite one another being non-square, wherein the width of the gap is substantially uniform about the perimeter of the first antenna element, and wherein the gap widens in the areas of the non-square corners of the first antenna element.

15. An antenna comprising:

a first substantially planar and substantially square antenna element, the first antenna element having four corners, two of the corners diagonally opposite one another being chamfered;

a second substantially planar antenna element surrounding the first antenna element, the first and second antenna elements being substantially coplanar, the second antenna element includes a substantially square inner edge and a substantially square outer edge, each of the inner and outer edges of the second antenna element including four corners, two of the corners on each of the inner and outer edges diagonally opposite one another being chamfered, the two corners of the inner edge being adjacent the two corners of the first antenna element, the two corners of the outer edge being remote from the two corners of the first antenna element; and a feed connected to only one of the first and second antenna elements with the other one of said first and second antenna elements not having a feed connected thereto and being parasitically fed, whereby at least two signals having different frequencies and different polarizations appear on the feed.

16. An antenna comprising:

a first antenna element adapted to receive a first signal having a first frequency and a first polarization;

a second antenna element adapted to receive a second signal having a second frequency different from the first frequency and a second polarization different from the first polarization;

a gap defined between an outer edge of the first antenna element and an inner edge of the second antenna element such that the first and second antenna elements are separated and do not physically contact each other; and a single feed connected to only one of the first and second antenna elements with the other one of said first and second antenna elements not having a feed connected thereto and being parasitically fed, whereby the first and second signals appear on the feed.

17. The antenna of claim 16, wherein the first and second polarizations are circular.

18. The antenna of claim 16, wherein the first and second antenna elements do not physically contact one another.

19. The antenna of claim 16, wherein the second antenna element surrounds the first antenna element.

20. The antenna of claim 16, wherein the first and second antenna elements are substantially planar and substantially coplanar.

21. The antenna of claim 20, wherein:

the first antenna element is substantially square; and the second antenna element includes a substantially square inner edge and a substantially square outer edge, the first and second antenna elements being substantially concentric.

22. The antenna of claim 21, wherein the first antenna element and the inner edge of the second antenna element define a generally uniform gap.

23. The antenna of claim 16, wherein the single feed is connected to the first antenna element.

24. The antenna of claim 23, wherein the second antenna element is parasitically fed without any feed connected to the second antenna element.

25. The antenna of claim 24, wherein the first antenna element is operable, independently from the second antenna element, for receiving left hand circularly polarized (LHCP) signals, and wherein the first and second antenna elements are operable collectively for receiving right hand circularly polarized (RHCP) signals.

26. The antenna of claim 25, wherein the antenna is operable for achieving different bands of operation and different circular polarizations simultaneously using only one feed.

* * * * *